United States Patent [19]

Ueta et al.

[11] Patent Number: 4,993,306

[45] Date of Patent: Feb. 19, 1991

[54] DEVICE FOR CORRECTING TIMING OF MUSIC PLAYING INFORMATION FOR USE IN MUSIC AUTO PLAY DEVICE

[75] Inventors: Noriyuki Ueta, Hamaamtsu; Akihiro Fujita, Iwata; Shu Eitaki, Hamakita, all of Japan

[73] Assignee: Kawai Musical Inst. Mfg. Co., Ltd., Sizuoka, Japan

[21] Appl. No.: 354,296

[22] Filed: May 19, 1989

[30] Foreign Application Priority Data

May 22, 1988 [JP] Japan ..... 63-124773
Jun. 9, 1988 [JP] Japan ..... 63-142614

[51] Int. Cl.[5] ..... G10H 1/00; G10H 1/36; G10H 1/40

[52] U.S. Cl. ..... 84/601; 84/634; 84/635; 84/462; 84/DIG. 12

[58] Field of Search ..... 84/600, 601, 602, 611, 84/612, 626, 635, 636, 651, 652, 662, 667, 668, 701, 713, 714, DIG. 12, 634, 610, 650, 712, DIG. 29

[56] References Cited

U.S. PATENT DOCUMENTS

| | | | |
|---|---|---|---|
| 4,154,132 | 5/1979 | Mishima | 84/635 |
| 4,256,005 | 3/1981 | Mishima | 84/635 |
| 4,542,675 | 9/1985 | Hall, Jr. et al. | 84/668 |
| 4,901,616 | 2/1990 | Matsubara et al. | 84/602 |

*Primary Examiner*—W. B. Perkey

[57] ABSTRACT

A device for correcting a timing of music playing information including a determining unit and a correcting unit, the correcting unit corrects the timing of the change of the performance of a piece of music, which is outside the range of short time data, to a timing within the range of the short time data, in response to a determination by the determining unit.

7 Claims, 5 Drawing Sheets

FIG. 1B PRECEDING SHIFT

FIG. 1C SUBSEQUENT SHIFT A=B

DEVICE FOR CORRECTING TIMING OF MUSIC PLAYING INFORMATION FOR USE IN MUSIC AUTO PLAY DEVICE

BACKGROUND OF THE INVENTION

1. Field of the Invention

The present invention relates to a auto play device for playing music (hereinafter referred to as an auto play device) based on a prememorized timing of a change of a performance of a piece of music, more particularly it relates to a device for correcting a timing of the music playing information by which a timing of a change of a performance of a piece of music is corrected to a timing occurring at a predetermined interval.

2. Description of the Related Art

FIG. 1A illustrates the timing correction operation performed by a known timing correction device. In FIG. 1A, the music playing information is corrected by a time length of an 8th note, which time length corresponds, for example, to a time length of 48 clock pulses (hereinafter referred to as CK). Note, the time length of 1 CK corresponds to the time length of a unit of time which represents a standard timing for processing the music playing information. Referring to FIG. 1A, a head timing of a bar is defined as "1", a timing which is the time length of an 8th note from the timing "1" is defined as "2", a timing which is the time length of an 8th note from the timing "2" is defined as "3", a timing which is the time length of an 8th note from the timing "3" is defined as "4", and so on, and timings between the timings "1", "2", "3", "4", . . . are defined as "1-2", "2-3", "3-4", "4-5", . . . The timing of the change of the music playing information between "1" and "1-2" is corrected to "1", the timing of the change of the music playing information between "1-2" and "2-3" is corrected to "2", the timing of the change of the music playing information between "2-3" and "3-4" is corrected to "3", and the timing of the change of the music playing information between "3-4" and "4-5" is corrected to "4". Accordingly the timing of the change of the music playing information is precisely corrected to a timing of an 8th note, and thus such a timing correction device provides a convenient and more exact playing of music.

Nevertheless, in practice a player does not always play at an exact timing, but often intentionally shifts from the exact timing by, for example, a "preceding shift" or a "subsequent shift",to produce delicate musical nuances.

Accordingly, a problem arises in that a musical performance becomes mechanical if the timing is corrected too exactly.

SUMMARY OF THE INVENTION

An object of the present invention is to provide a device for correcting a timing of music playing information, which device is capable of easily carrying out a shift from an exact musical timing by, for example, a "preceding shift" or a "subsequent shift".

According to the present invention, there is provided a device for correcting a timing of music playing information for use in an auto playing device which comprises: a music playing information memorizing means for memorizing a timing of a change of a performance of a piece of music, a long time data memorizing means for memorizing long time data, the timing of the change of the performance of the piece of music being corrected to an exact timing occuring at each interval of long time data: a short time data memorizing means for memorizing short time data, a time of the short time data being shorter than a time of the long time data, the short time data being set around the timing occuring at each interval of long time data; a determining means for determining whether or not the timing of the change of the performance of the piece of music is within a range of the short time data; and correcting means for correcting the timing of the change of the performance of the piece of music, which is outside the range of the short time data, to a timing within the range of the short time data, in response to a determination by the determining means.

In the present invention, when the timing of the music playing information is within the range of the short time data, the timing of the musical playing information is not corrected, and when the timing of the music playing information is outside the range of the short time data, the timing of the musical information is corrected and brought within the range of the short time data, which is shifted from the exact timing. Therefore, the timing of the performance of the piece of music can be intentionally shifted. Accordingly, a state which is shifted from a exact timing based on a performance of a piece of music, i.e., a "preceding shift" or a "subsequent shift", is accurately obtained, and the performance of the piece of music is brought to a high level. Moreover, a timing of a change of a predetermined content of a performance of a piece of music, for example, a timing of a change of only a snare drum sound or only a cymbals sound can be minutely shifted, and thus a more harmonious auto playing of a piece of music can be realized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 2:
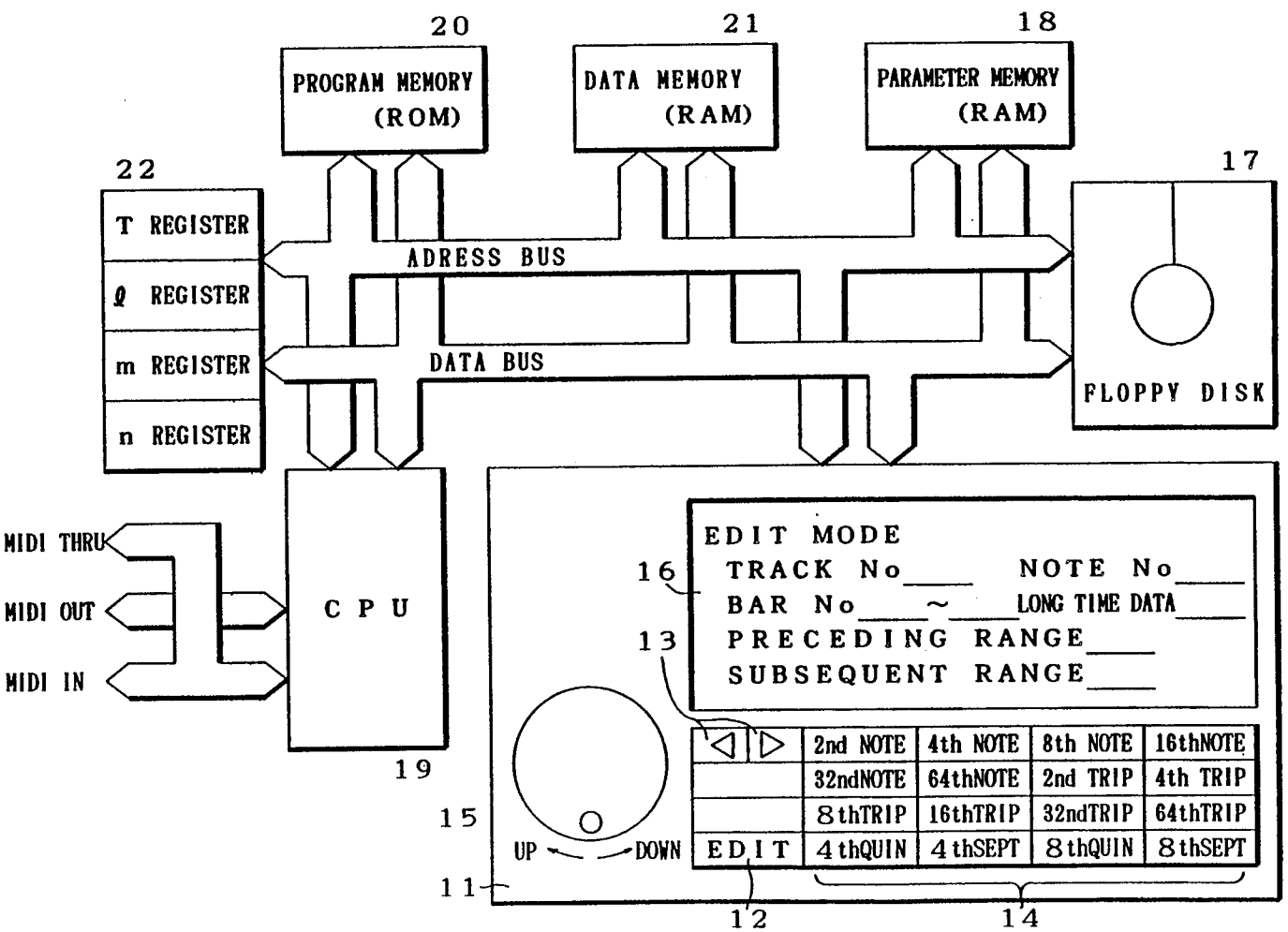
FIG. 2 is a diagram of a circuit for a music auto playing device.

FIG. 2 is a diagram of a circuit for a MIDI (Musical Instrument Digital Interface) type auto playing device.

Referring to FIG. 2, reference numeral designates an input key board provided with an edit key 12, a cursor key 13, note keys 14, an incrementer 15, and an LCD (Liquid Crystal Device) display 16. The edit key 12 is used for selecting an edit mode when correcting a change of a performance of a piece of music. When the edit mode is selected, as shown in FIG. 2, each parameter for the edit is indicated at the LCD display 16, to enable the parameter to be set. The value of the data of each parameter is set or changed by the incrementer 15, i.e., when the incrementer 15 is turned clockwise the value of the data is incremented, and when incrementer 15 is turned counterclockwise the value of the data is decremented. The cursor key 13 is used for selecting the parameter indicated in the LCD 16 by moving the cursor to set or change the value of the data of the parameter.

Figure 3:
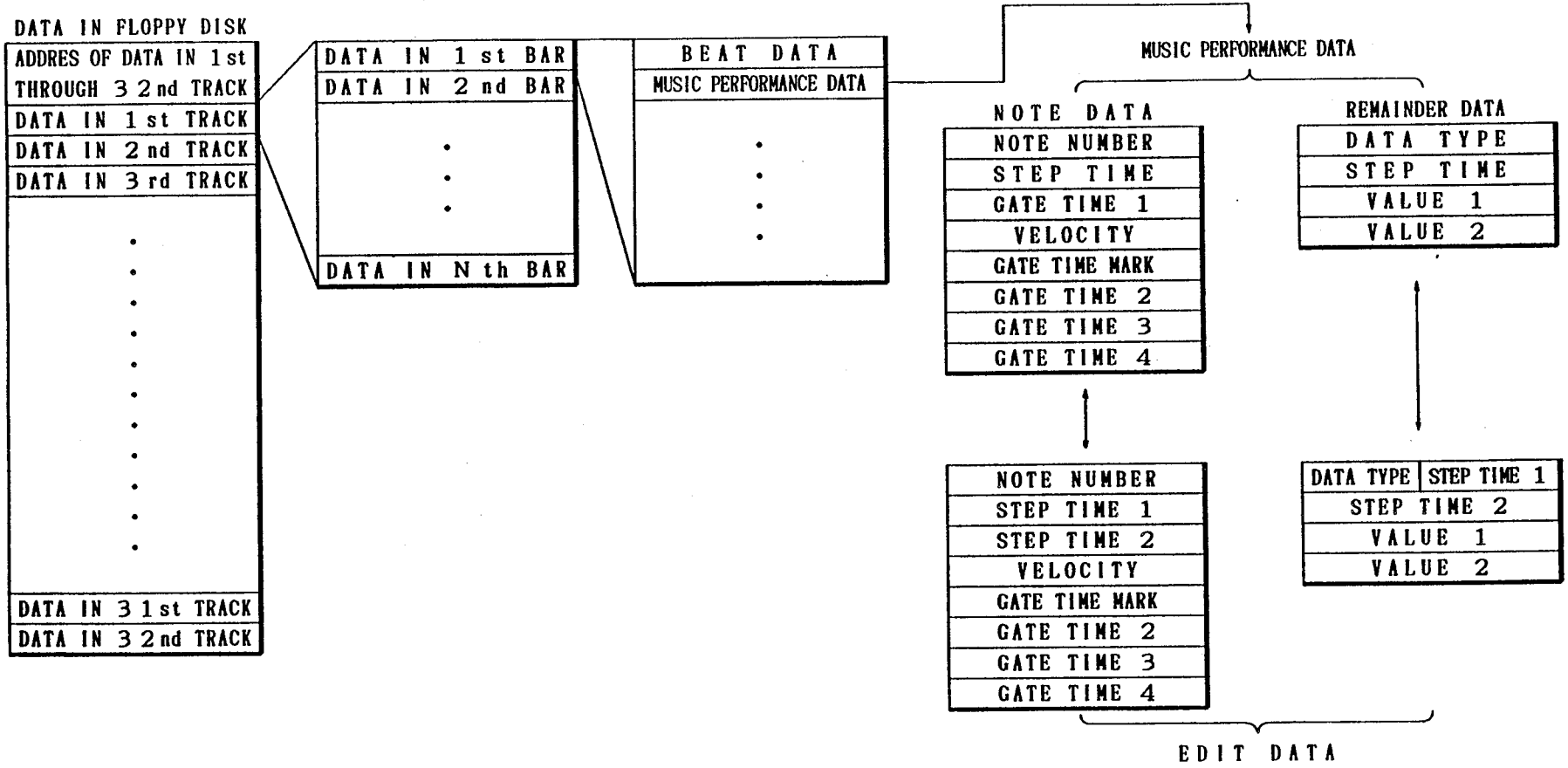
FIG. 3 is a diagram illustrating a memory format in a floppy disk.

In the LCD display 16, a track number, a note number, a bar range, long time data, a preceding clock range, and a subsequent clock range are indicated. As shown in FIG. 3, the track number indicates a track number of one of 32 tracks in the floppy disk 17 to be edited. The floppy disk 17 is described hereinafter. In one track, data of the performance of one piece of music is memorized. The note number designates one of a melody, an accompaniment or a rhythm of the performance data. Also, the note number can designate only a similar octave or only a similar tonal pitch in the melody, only a bass or a backing in the accompaniment, or only a cymbals or high hat sound in the rhythm. This designation is selected by the incrementer 15. The bar range represents a bar range to be edited for example, if the range is "2-8", the bar range from a second bar to an eighth bar is edited.

The range between a preceding short time data A and a subsequent short time data B is the short time data range, and thus no corrections are made. The preceding short time data A indicates the range from the timing at each interval of the long time data to a preceding boundary of the range of the short time data, and the subsequent short time data B indicates the range from the timing at each interval of the long time data to a subsequent boundary of the range of the short time data. The musical performance data, which exists between a timing which is a half of a length of the long time data before the timing of the long time data and the timing of the preceding short time data A, is corrected to the timing of the preceding short time data A. The musical performance data, which is between the timing which is a half of a length of the long time data after the timing of the the long time data and the timing of the subsequent short time data B, is corrected to the timing of the subsequent short time data B.

The values of the preceding and the subsequent short time data A and B are set by the incrementer 15 by the number of CK. For example, the time length of a 32nd note is represented by setting the CK number to 12.

When the incrementer 15 is at the center position, the CK number is equal to 0, and when incrementer 15 is moved from the center position, the CK number is incremented or decremented. If the preceding and the subsequent short time data A and B are smaller than 0, the preceding and the subsequent short time data A and 8 are set before the timing occurring at each interval of the long time data b, and thus a "preceding shift" playing is obtained. Conversely if the short time data A and B are longer than 0, the preceding and the subsequent short time data A and B are set after the timing occurring at each interval of the long time data b, and thus a "subsequent shift" playing is obtained.

The long time data b indicates a predetermined time length, and the musical performance data is corrected by a timing occurring at each such predetermined time length. The value of the long time data b is set by operating one of the note keys 14. The note keys consists of 16 keys, i.e., a 2nd note key, a 4th note key, an 8th note key, a 16th note key, a 32nd note key, a 64th note key, a 2nd note triplet key, a 4th note triplet key, an 8th note triplet key, a 16th note triplet key, a 32th note triplet key, a 64th note triplet key, a 4th note quintuplet key, a 4th note septuplet key, an 8th note quintuplet key and an 8th note septuplet key, and the value of the long time data b corresponds to the time length of each note set by these 16 keys.

The parameter data set by the input key portion 11 is memorized in a parameter memory iB, and an edit operation with that parameter data occurs. In the CPU 19, the music playing information to be edited, which is memorized in the floppy disk 17, is loaded to the data memory 21 and then edited based on a program memorized in a program memory 20.

As shown in FIG. 3, the floppy disk 17 has a memory capacity of 32 tracks, and the information for playing one piece of music is memorized in each track. The information for playing one piece of music memorized in each track comprises a plurality of bar data, each bar data consisting of one beat data and a plurality of playing data. The playing data consists of note data and remainder data, and the note data consists of one byte data of the note number, one byte data of a step time, and one byte data of a velocity. The note number represents a tonal pitch, the step time represents a time from the head of the bar to a timing of a key on, the gate time represents a time from a timing of key on to a timing of key off, and the velocity represents a loudness. A gate time mark, a gate time 2, a gate time 3, and a gate time 4 in the note data in FIG. 3 are data areas which are used when the data in the gate time is more than one byte. In the remainder data, the contents of an effect data, for example, a bender and an after touch, etc., are memorized. This remainder data consists of a data type, a step time, and values, wherein the data type represents an effect, the step time represents a time length from the head of the bar to the time when a change is made in the effect, and the value represents the degree of change of the effect. The data form of the note data and the data form of the remainder data are converted when the edit is carried out. In this case, the note number, the velocity, the gate time, the data type, and the value are not changed, but the step data is converted to data which represents a time from the head of the track, not from the head of the bar.

A register memory 22 includes a T register, an 1 register, an m register, and an n register. The data of the step time, which timing is corrected, is set in the T register, the count data, which represents how many intervals of long time data b in the step time, is set in the 1 register, an address data for reading the musical performance data is set in the m register, and an address data for reading the bar data is set in the n register. The MIDI data is input to the the CPU 19 via a MIDI input terminal (MIDI IN), and is memorized in the parameter memory 18, the data memory 21 or the floppy disk 17. The data memorized in the floppy disk 17, the parameter memory 18, or the data memory 21 is output by the the CPU 19 via a MIDI output terminal (MIDI OUT). and the input data via the MIDI input terminal (MIDI IN) is output to another MIDI musical instrument via a MIDI through out terminal (MIDI THRU).

The operation and the effect of the above auto play device will be now described.

Figure 4A:
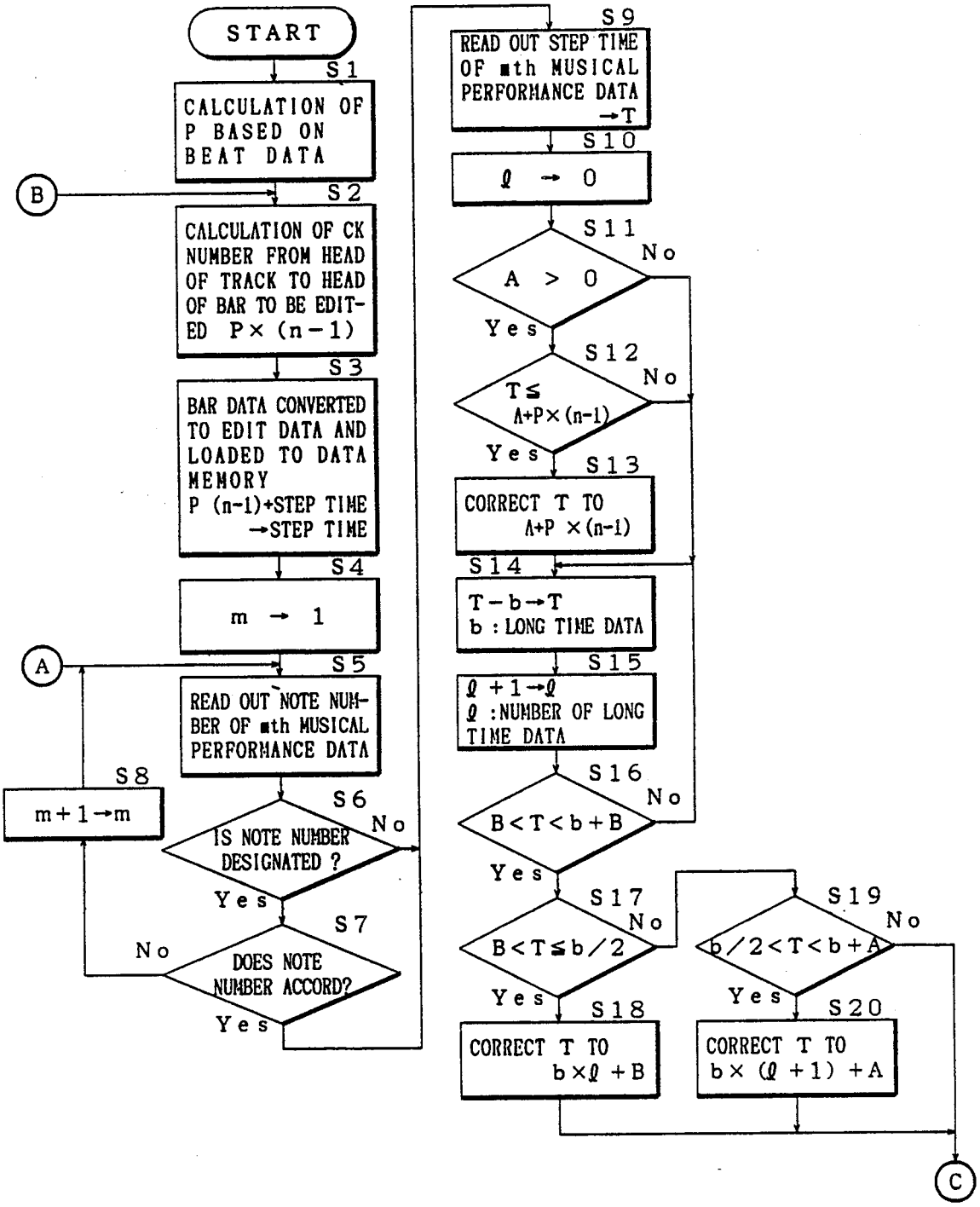
FIGS. 4A and 4B illustrate a flow chart for executing an edit process.
Figure 4B:
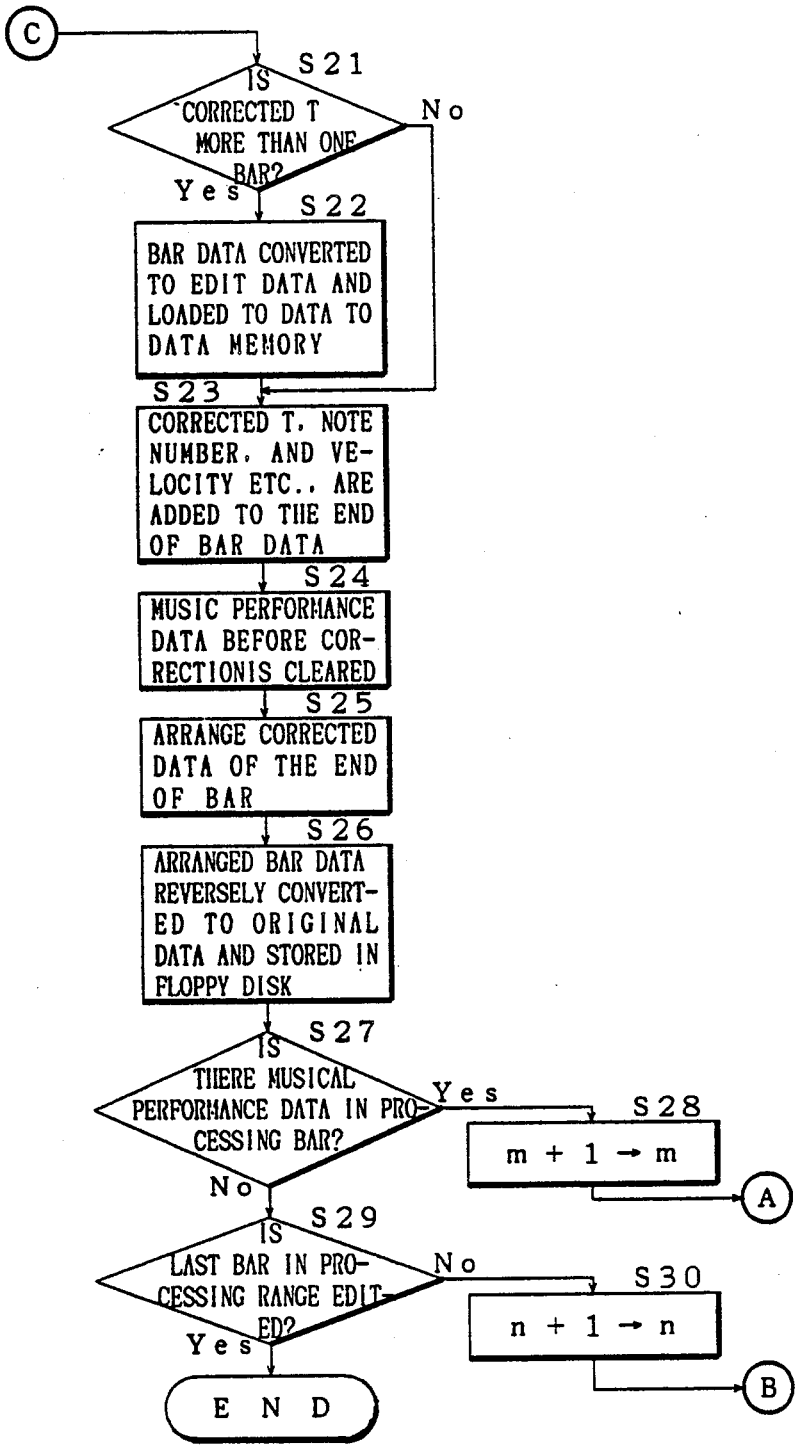

FIGS. 4A and 4B illustrate a flow chart for executing the edit operation. In step S1 through step S9, the music performance data in the bar data to be corrected is sequentially read out. In step S10 through step S13, when the preceding short time data A is larger than 0, the timing of the music performance data, which is in the range from the head of the bar to the preceding short time data A, is corrected, and in step S14 through s16, the number 1 of the long time data b contained in the step time of the music performance data is determined. In step S17 through step S20, if a remainder is longer than the subsequent short time data B and equal to or smaller than a half of the the long time data b, the data T is corrected to the timing b×1+B, which represents the timing of the subsequent short time data, if the remainder is longer than a half of the long time data b and equal to or smaller than b+A, the data T is corrected to the timing b×(1+1)+A, which represents the timing of the preceding short time data, and if the remainder is between the preceding and the subsequent short time data, the data T is not corrected. When in step S21 through step S26, the corrected data is arranged in the oorresponding positions, and in step S27 through step S30, all music performance data or all bars to be edited are also processed as above.

After the edit parameters are set by the cursor key 13, the note key 14 or the incrementer 15, a display in the LCD 16 is replaced by another display and then the flow illustrated in the chart of FIGS. 4A and 4B is executed. In step S1, the CK number P in one bar of a music in a track to be edited is calculated, based on the beat data. The CK number P represents an unit of time which is a standard timing for processing the music playing information. In this embodiment, the time length of an 8th note is defined as 48 CK, and accordingly, to obtain a four-four time, the CK number P in one bar is 384 CK (=96×4), and for a six-eight time, the CK number P in one bar is 288 CK (=48×6). Then, in step S2, a total CK number from the head of the track to the head bar of the bar range to be edited is calculated. In this case, if the head bar n is equal to 5, the total CK number is equal to P(CK number in one bar)×4 (=P×(n−1)). In step S3, the music performance data in the bar is converted to the edit data and is loaded form the floppy disk 17 to the data memory 21. At the same time, P×(n−1) is added to the step time, and thus the step time is converted to represent the time from the head of the track.

Then, in step S4, the address data m for reading out the music performance data is set to 1, and in step S5, the note number of the first music performance data is read. In step S6, if the note to be edited is not designated in the parameter, the routine goes to step S9, but if the note to be edited is designated then, in step S5 through step S8, the address data m to be read out is incremented by 1 and the note numbers of the music performance data are read out one after another until a note number corresponding to the designated note is read, the routine goes to step S9, and accordingly, the timing of the specific content of the performance of the piece of music, for example, only a snare drum or cymbals sound, is corrected.

In step S9, the step time of the note number, which is read as described above, is memorized in the T register. Then in step S10, the 1 register is cleared, and in step S11, it is determined whether or not the value of the preceding short time data A is smaller than 0. If the value is larger than 0, the routine goes to step S14. A description of the case in which the value is larger than 0 will be given later. In step S14 through step S16, the long time data b is successively subtracted from the step time until the value of the step time in the T register between the subsequent short time data B and the sum of the long time data b and the subsequent short time data B, and the number times this subtraction is made is memorized in the 1 register. In step S16, if T is larger than B and smaller than b+B, the routine goes to step S17 and it is determined whether or not the step time is larger than the subsequent short time data B and equal to or smaller than a half of the the long time data b. Then, step S19, it is determined whether or not the step time is larger than a half of the long time data b and smaller than sum of the preceding short time data A and the long time data b.

Figure 1A:
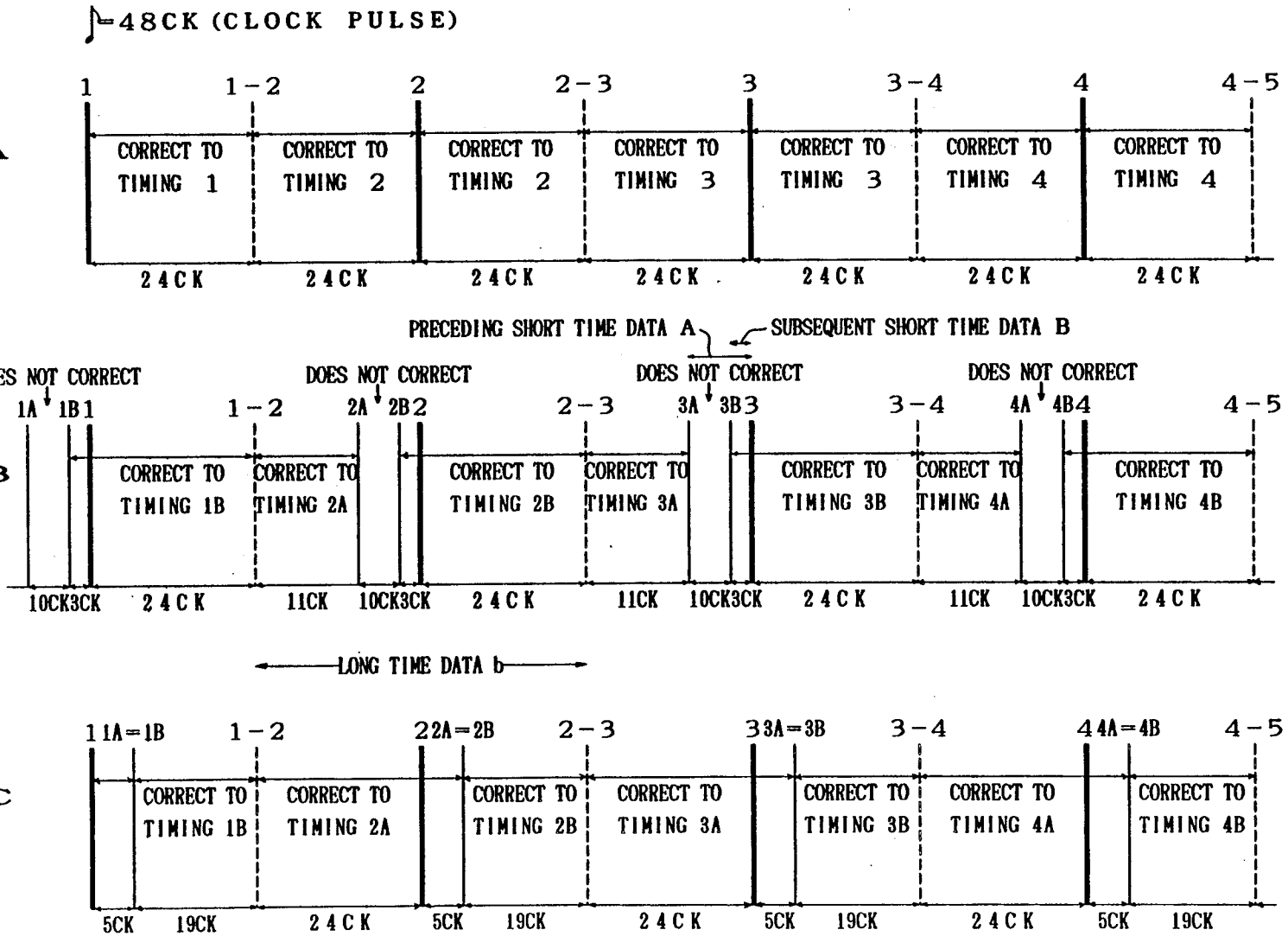
FIG. 1A PRIOR ART
FIG. 1 is a time chart showing the operation of a timing correction from related art.

In FIG. 18, the preceding short time data A is −13 CK, the subsequent short time data B is −3 CK, and the the long time data b is an 8th note, i.e., 48 CK. Referring to FIG. 1B, if the timing is between "1B" and "2B", it is determined whether or not the timing is between "1B" and "1-2" (step S17), and then it is determined whether or not the timing is between "1-2" and "2A" (step S19). If $B<T\leqq b/2$, i.e., the timing is between "1B" and "1-2", the data T is corrected to the "1B" timing, i.e., the timing b×1+B, and the corrected data T is memorized in the T register (step S18). If $b/2<T<b+A$, i.e., the timing is between "1-2" and "2A", the data T is corrected to the "2A" timing, i.e., the timing b×(1+1)+A, and the corrected data T is memorized in the T register (step S20). This operation is carried out in a similar manner in the case of between "2B" and "3B", and between "3B" and "4B", . . . Therefore when the timing correction of the music performance data is carried out, the music performance data is corrected to the timing between the preceding and the subsequent short time data A and B, which is not the exact timing "1", "2", "3", "4"occurring at each interval of the the long time data b of an 8th note, but is a timing intentionally preshifted. Accordingly, the music performance data, which is at an exact timing such as "1", "2", "3", "4", also is corrected to make an intentional shift from the exact timing, and therefore, a delicate nuance of the "preceding shift" can be precisely obtained.

The data for "1A"~"1B", "2A"~"2B", "3A"~"3B", or "4A"~"4B" is not corrected, and accordingly, a timing between the preceding short time data A and the subsequent short time data B is maintained as is, and thus the delicate nuance of the "preceding shift" is maintained.

At this time, if the corrected step time data is more than the time of one bar, as in step 3, the bar data is converted to the edit data to oonvert the step time to a time data from a head of the track, and the bar data is loaded to the parameter memory 18 (step S21, step S22).

After the timing correction, in step S23, the corrected step time, the gate time, the note number, and the velocity, etc., are added to the end of the bar data to which the corrected music performance data belongs, and in step S24, the music performance data in the bar data before correction is cleared. In step S25, the corrected music performance data, which is added to the end of the bar (step S23), is arranged in the order of a length of the step time, and in step S26, the arranged bar data is reversly converted to the original data form, and the arranged bar data is stored in the floppy disk 17. All of the music performance data in the bar data to be processed is processed in the same way as in step S5 through step S26 (step S27), and the m registor is incremented by 1 (step S28). Furthermore, a similar process is carried out for all of the notes to be edited (step S29), and the n registor is incremented by 1 (step S30).

In FIG. 1C, the preceding short time data A and the subsequent short time data B are set to +5 CK. In this case, the process in step S1 through step S10 is similar to the process carried out when the preceding and subsequent short time data A,B are smaller than 0. In step S11, since it is determined that the preceding short time data A is larger than 0, the routine goes to step S12. In step S12, it is determined whether or not a step time in the T registor is equal to or smaller than $A+P\times(n-1)$; where $P\times(n-1)$ represents a total number of clock pulses between a head of the track and a head of a bar to be edited. Namely, in step 12, it is determined whether or not the step time in the T register is a timing between "1" and "1A" in FIG. 1C. If the step time in the T register is a timing between "1" and "1A", the data T is corrected to $A+P\times(n-1)$, i.e., a timing of "1A", and memorized in the T register (step S13). This process (step S11~step S13) is carried out when the preceding short time data A is more than 0, because the timing of the music performance data, which is between "1" and "1A", can not be corrected in step S14 through step S20.

The timing correcting process (step S14~step S20), and arranging process (step S21~step S30), etc., are carried out on other music performance data. The music performance data is not corrected to the timing "1", "2", "3","4" occurring at each interval of the the long time data b, but is corrected to the timing that has been shifted between the preceding short time data A and the subsequent short time data B. The timing of the music performance data, which is "1", "2", "3","4" is corrected to be intentionally shifted, and thus a delicate nuance of a subsequent timing can be precisely obtained.

In this embodiment, the part of the performance to be corrected can be freely selected by selecting the note number; for example, a timing of only a predetermined note or of only a predetermined musical tone can be corrected. Accordingly the content of the performance of a piece of music is not uniformly corrected. In particular, to ensure an optimum performance of a piece of music and a smooth data processing, preferably a timing of the effect data, for example, the bender or the after touch, etc., is not corrected.

Moreover, when the preceding short time data A is smaller than 0 and the subsequent short time data B is larger than 0, the timing of the music performance data is corrected to a timing which has been shifted to both before and after the exact timing "1", "2", "3", "4", and therefore, the "preceding shift" and the "subsequent shift" are carried out at the same time.

While the invention has been described with reference to specific embodiments chosen for purposes of illustration, it should be apparent that numerous modifications can be made thereto by those skilled in the art without departing from the basic concept and scope of the invention.

For example, a corrected timing position may be different from the position of the preceding and subsequent short time data A, 8. In this case, the values of B, A in step S18 and in step S20 are changed.

Moreover, the range of the short time data may not be set by a preceding and a subsequent boundary, but may be set by a center of the range and a range from the center, or in any other manner. Further, the range of the short time data may be fixed. The range need not be set by the incrementer 15, but can be set by note key 14. It is further noted that usually the long time data corresponds to a beat, but this is not limited thereto in this embodiment.

We claim:

1. A device for correcting a timing of music playing information for use in an auto play device, comprising:
   music playing information memorizing means for memorizing a timing of a change of a performance of a piece of music;
   long time data memorizing means for memorizing a long time data, the timing of the change of the performance of a piece of music being corrected to an exact timing occurring at each interval of said long time data;
   short time data memorizing means for memorizing a short time data, a time length of said short time data being shorter than a time length of said long time data, said short time data being set around a timing occuring at each interval of said long time data;
   determining means for determining whether or not the timing of the change of the performance of a piece of music is within a range of said short time data; and
   correcting means for correcting the timing of the change of the performance of a piece of music, which is outside the range of said short time data, to a timing within the range of said short time data, in response to a determination by said determining means.

2. A device for correcting a timing of music playing information for use in an auto play device according to claim wherein said correcting means corrects only a predetermined content of the performance of a piece of music.

3. A device for correcting a timing of music playing information for use in an auto playing device according to claim 1, wherein said long time data corresponds to a beat of the performance of a piece of music.

4. A device for correcting a timing of music playing information for use in an auto play device according to claim wherein the range of said short time data is set about the timing occurring at each interval of said long time data.

5. A device for correcting a timing of music playing information for use in an auto play device according to claim 1, wherein the range of said short time data is set before or after the timing occurring at each interval of said long time data.

6. A device for correcting a timing of music playing information for use in an auto play device according to claim 1, wherein said musical playing information is composed of at least one of melody information, accompaniment information, and rhythm information.

7. A device for correcting a timing of music playing information for use in an auto play device according to claim 1, wherein said timing of the change of a performance of a piece of music represents a timing at which a sound is produced.

* * * * *